US009260863B2

(12) United States Patent
Thun et al.

(10) Patent No.: US 9,260,863 B2
(45) Date of Patent: Feb. 16, 2016

(54) DYNAMICALLY RESPONSIVE ACOUSTIC TUNING ENVELOPE SYSTEM AND METHOD

(71) Applicants: Geoffrey Thun, Ann Arbor, MI (US); Elizabeth Sauve, Ann Arbor, MI (US); Raj Patel, New York, NY (US); Terence Caulkins, New York, NY (US); David Rife, New York, NY (US)

(72) Inventors: Geoffrey Thun, Ann Arbor, MI (US); Elizabeth Sauve, Ann Arbor, MI (US); Raj Patel, New York, NY (US); Terence Caulkins, New York, NY (US); David Rife, New York, NY (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 0 days.

(21) Appl. No.: 14/383,945

(22) PCT Filed: Mar. 6, 2013

(86) PCT No.: PCT/US2013/029264

§ 371 (c)(1),
(2) Date: Sep. 9, 2014

(87) PCT Pub. No.: WO2013/134340

PCT Pub. Date: Sep. 12, 2013

(65) Prior Publication Data

US 2015/0060193 A1 Mar. 5, 2015

Related U.S. Application Data

(60) Provisional application No. 61/608,985, filed on Mar. 9, 2012.

(51) Int. Cl.

| | |
|---|---|
| ***E04B 1/82*** | (2006.01) |
| ***E04B 9/34*** | (2006.01) |
| *E04B 1/99* | (2006.01) |
| *E04B 9/00* | (2006.01) |

(52) U.S. Cl.
CPC . *E04B 9/34* (2013.01); *E04B 1/994* (2013.01); *E04B 9/003* (2013.01)

(58) Field of Classification Search
CPC ..... E04B 1/82; E04B 1/86
USPC ..... 181/286; 52/144, 145
See application file for complete search history.

(56) References Cited

U.S. PATENT DOCUMENTS

| | | | | |
|---|---|---|---|---|
| 3,447,628 | A * | 6/1969 | Shiflet | 181/30 |
| 4,094,379 | A | 6/1978 | Steinberger | |

(Continued)

FOREIGN PATENT DOCUMENTS

| | | | |
|---|---|---|---|
| FR | 2364309 | A1 | 4/1978 |
| GB | 375726 | A | 6/1932 |
| WO | WO-2004022874 | A1 | 3/2004 |

OTHER PUBLICATIONS

International Search Report for PCT/US2013/029264, dated Jul. 18, 2013.

*Primary Examiner* — Forrest M Phillips
(74) *Attorney, Agent, or Firm* — Marshall, Gerstein & Borun LLP

(57) ABSTRACT

A dynamic responsive acoustic tuning envelope system that includes a movably connected set of cells, each possessing sound reflecting, sound absorbing, and/or electro-acoustic properties, and which are assembled according to the principles of rigid origami. So configured, the system is capable of both localized surficial deformation to alter the material surface exposure, transform its textural profile, and alter the enclosed volume of space in a single material envelope, thereby tuning the acoustics of the environment in which the system resides.

26 Claims, 11 Drawing Sheets

(56) References Cited

U.S. PATENT DOCUMENTS

| | | | | | |
|---|---|---|---|---|---|
| 4,356,880 | A * | 11/1982 | Downs | 181/30 |
| 4,832,147 | A * | 5/1989 | Dear et al. | 181/30 |
| 6,006,476 | A | 12/1999 | Zarnick | |
| 6,793,037 | B1 * | 9/2004 | Babuke et al. | 181/293 |
| 7,261,182 | B2 * | 8/2007 | Zainea | 181/293 |
| 7,604,094 | B2 * | 10/2009 | Magyari | 181/286 |
| 7,703,575 | B2 * | 4/2010 | Berger et al. | 181/293 |
| 8,960,367 | B1 * | 2/2015 | Leclerc | 181/286 |

* cited by examiner

DYNAMICALLY RESPONSIVE ACOUSTIC TUNING ENVELOPE SYSTEM AND METHOD

CROSS REFERENCE TO RELATED APPLICATIONS

This is the U.S. national phase of PCT/US2013/029264, having an international filing date of Mar. 6, 2013, which claims the priority benefit of U.S. Provisional Patent Application No. 61/608,985, filed Mar. 9, 2012, the entire contents of each of which is incorporated herein by reference.

FIELD OF THE DISCLOSURE

The present disclosure is directed to a system for tuning the acoustic envelope of a designated space and, more particularly, to a dynamic system for tuning the acoustic envelope within a designated space.

BACKGROUND

Within the field of contemporary acoustic design, numerous products and systems have been developed that may be added to the interior of an existing space to modify the sound reflecting and sound absorbing characteristics of that space. Evidence of this work is ubiquitous and typically involves reflector panels, variable absorption curtains, and/or electro-acoustic systems often operating in tandem to produce the desired acoustic outcomes. Dynamic "sound clouds" offer a computationally-controlled set of sound reflecting surfaces that can be digitally actuated in response to changing acoustic demands by virtue of variations in their physical deployment and orientation.

"Responsive Envelopes" constitute an area of architectural research that pursues the design of multi-functional surfaces that adjust their formal configuration in response to varying environmental conditions in order to transform the envelope's impact upon its environment. While there have been few efforts to synthesize variable acoustic response into single geometric surface-based systems capable of producing modifications in aural characteristics, there has not been the development of a composite envelope-based system that possesses the capacity for predictive volumetric and surficial performance variation based on the alteration of its surface and/or volumetric characteristics while simultaneously configuring electro-acoustic amplification within the system.

SUMMARY

One aspect of the present disclosure provides a system including an acoustic shell, a plurality of hinges, a plurality of surficial actuators, and a control system. The acoustic shell comprises a plurality of panels arranged in a tessellated pattern relative to one another, the plurality of panels including at least one sound reflecting panel and at least one sound absorbing panel. The at least one sound reflecting panel has an exposed surface a majority of which comprises a sound reflecting surface. The at least one sound absorbing panel has an exposed surface a majority of which comprises a sound absorbing surface. The plurality of hinges connect edges of at least some of the panels to edges of immediately adjacent panels such that each panel is movably connected to at least one other panel. Each of plurality of surficial actuators is connected between at least two of the plurality of panels for moving the two panels relative to each other such that the plurality of surficial actuators can manipulate the plurality of panels to change the overall sound reflecting and sound absorbing properties of the acoustic shell. The controller is for at least controlling the surficial actuators.

Another aspect of the present disclosure provides a venue comprising a housing, an acoustic shell, a plurality of hinges, a plurality of surficial actuators, and a control system. The housing defines a space having ambient properties. The acoustic shell is suspended within the space of the housing, and includes a plurality of panels arranged in a tessellated pattern relative to one another. The plurality of panels include at least one sound reflecting panel and at least one sound absorbing panel. The at least one sound reflecting panel has an exposed surface a majority of which comprises a sound reflecting surface. The at least one sound absorbing panel has an exposed surface a majority of which comprises a sound absorbing surface. The plurality of hinges connect edges of at least some of the panels to edges of immediately adjacent panels such that each panel is movably connected to at least one other panel. Each of the plurality of surficial actuators is connected between at least two of the plurality of panels for moving the two panels relative to each other such that the plurality of surficial actuators can manipulate the plurality of panels to change the overall sound reflecting and sound absorbing properties of the acoustic shell. The controller is for at least controlling the surficial actuators.

Another aspect of the present disclosure provides a method of controlling the acoustics of a space. The method includes determining a set of desired acoustic characteristics for a space. The method additionally includes determining a desired sound absorbing property of a tessellated acoustic shell that is suspended within the space, the tessellated acoustic shell comprising a plurality of panels, the plurality of panels including at least one sound reflecting panel and at least one sound absorbing panel, the at least one sound reflecting panel having an exposed surface a majority of which comprises a sound reflecting surface, the at least one sound absorbing panel having an exposed surface a majority of which comprises a sound absorbing surface. The method further includes determining a desired sound reflecting property of the tessellated acoustic shell. Still further, the method includes adjusting actual sound absorbing and sound reflecting properties of the tessellated acoustic shell toward the desired sound absorbing and reflecting properties by moving at least one of the plurality of panels of the tessellated acoustic shell relative to each other.

GENERAL DESCRIPTION

Figure 1:
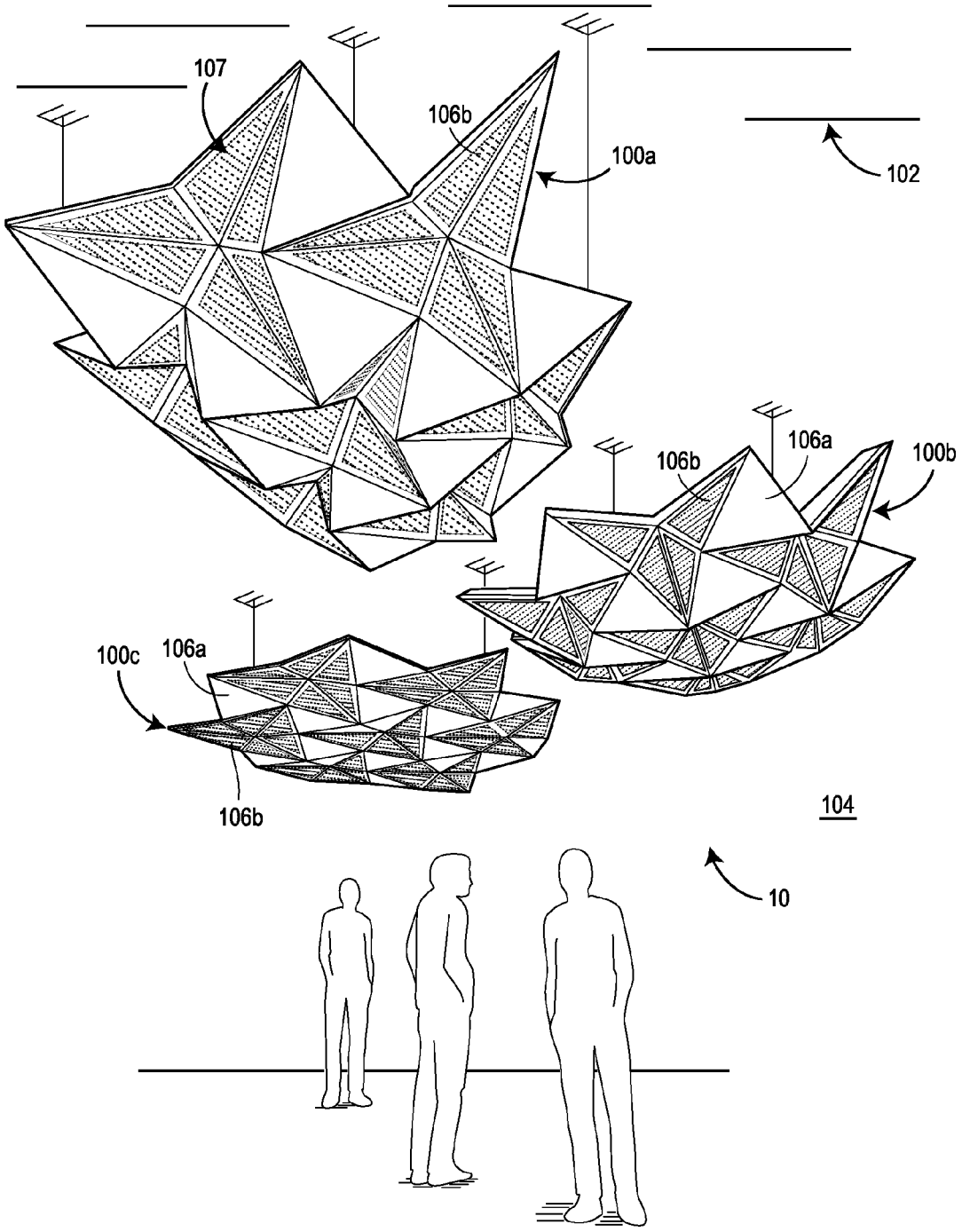
FIG. 1 is a perspective view of one example of a system constructed in accordance with the principles of the present disclosure.

The present disclosure is directed to a dynamic responsive acoustic tuning envelope system that, in one example, includes a continuous composite membrane-connected set of cells, each possessing sound reflecting, sound absorbing, or electro-acoustic properties that are assembled according to the principles of rigid origami. So configured, the system is capable of both localized surficial deformation to alter the percentage material surface exposure, transform its textural profile, and alter the enclosed volume of space in a single material envelope. The panelized system is unified by its connection to the continuous composite flexible membrane, to which leading edge exposed surfaces and framed backpanels are affixed. The connection to the membrane can be achieved by way of adhesive or by way of mechanical fixtures such as clamps or other devices. One example of the system could include the following types of panels: (i) solid sound reflecting panels including a total material thickness of 1¼" and possessing a material density of 2.5 psf, (ii) sound absorbing panels consisting of a ¼" thick face panel perforated to provide a minimum of 25% exposure to, and backed with 2" of porous extruded polypropylene milled to meet the geometric requirements of the overall system limitations in extreme conditions of flat-folding, and, optionally, (iii) electro-acoustic panels consisting of an internally milled 3⁄16" resonating panel equipped with a piezoelectric acoustic transducer. In this way, the panel becomes a Distributed Mode Loudspeaker (DML), in which sound is produced by inducing uniformly distributed vibration modes in the panel through a special electro-acoustic exciter. DMLs function differently than most other speakers, which typically produce sound by inducing pistonic motion in the diaphragm. Exciters for DMLs include, but are not limited to, moving coil and piezoelectric devices, and are placed to correspond to the natural resonant model of the panel.

The specific geometric configuration and percentage of each panel within the total envelope design of the present disclosure are determinate of desired overall system performance of a specific space. Localized deformation of the system surface geometry can be achieved via a number of linear actuators—determined by the degrees of freedom of the geometric configuration, mounted to the reverse surface (e.g., back side) of the sound absorbing panel (or other panel) assemblies and causes localized contraction (and expansion) of the corresponding facial exposure of each panel. By virtue of rigid origami structures, these actions are conveyed to other locations within the envelope through a determinate number of degrees of freedom. In addition to this localized surficial deformation, gross deformation to alter the overall acoustic volume enclosed by the system can be achieved through triangulated cable-stayed suspension linked to a frame mounted stepper motor array above, or through any other suitable device. Actuation controls and system signals can be sent to the envelope wirelessly through a control system capable of utilization towards a variety of performance goals.

Potential applications of the system range from large scale field deployment in the design of musical performance venues with multiple performance types (e.g., musical content and audience configuration), flexible entertainment venues with varying spatial and performance demand (e.g., convention centers, auditoria, etc.), specialized venues for multimedia presentations (e.g., boardrooms, meeting rooms, etc.), lecture halls, gymnasiums, classrooms, work spaces that benefit from environmental acoustic control, highly specialized experimental music performance venues where multichannel playback through electro-acoustic panels can be paired with dynamic real-time actuation of the system, and virtually an unlimited number of other types of similar venues and spaces. The system may also be capable of responding to occupancy (e.g., the presence or the lack of presence of individuals in the space) and noise levels through material exposure (e.g., in educational spaces, galleries, restaurants, etc.).

DETAILED DESCRIPTION

Turning now to the figures, various representative examples of systems and methods in accordance with the principles of the present disclosure will be described.

FIG. 1 depicts one example of a system 10 based on the principles of the present disclosure that includes one (1) to three (3) acoustic shells 100*a*, 100*b*, 100*c* suspended from a ceiling 102 of a space 104 (e.g., auditorium, gymnasium, lobby, concert venue, classroom, etc.). The acoustic shells 100*a*, 100*b*, 100*c* depicted in FIG. 1 are essentially identical in construction, and therefore, the reference numeral 100 will be used generically to refer to any one of the shells 100*a*-100*c*. Each shell 100 includes a plurality of panels 106 arranged in a tessellated pattern and pivotally connected to each other such as to allow localized surficial deformation of the acoustic shell 100. The plurality of panels 106 of the example depicted in FIG. 1 include sound reflecting panels 106*a* and sound absorbing panels 106*b*. Additionally, in this example, one of the shells includes at least one electronics panel 106*c* as part of a control system, as will be described. The electronics panel 106*c* may or may not possess a sound reflecting or sound absorbing property. In the depicted example, the panels 106 are configured in accordance with the geometric properties of rigid origami utilizing two different sizes of triangles. More specifically, the sound reflecting panels 106*a* include triangles of a first size, while the sound absorbing panels 106*b* include triangles of a second size that is smaller than the first size. This is merely one example, however, and other sizes and shapes of panels can be used, as will be discussed more below. Additionally, as can be seen, the sound absorbing panels 106*b* of this example are arranged in clusters 107 (one of which is highlighted in FIG. 1 with a darkened perimeter line) that themselves define larger triangles.

So configured, and as can be seen in FIG. 1, the foremost and middle acoustic shells 100*a*, 100*b* are depicted in partially opened/partially closed configurations, whereby the sound reflecting panels 106*a* are completely exposed to the space and the sound absorbing panels 106*b* are partially exposed to the space. Said another way, the sound absorbing panels 106*b* are partially folded such that each cluster 107 defines a variable interior volume of space in the form of a recess in the shell 100. By comparison, the rear-most acoustic shell 100*c* is depicted in a fully opened flat configuration, whereby the sound reflecting panels 106*a* and the sound absorbing panels 106*b* are completely exposed to the space and occupy a common flat plane. The foremost and middle shells 100*a*, 100*b* depicted in FIG. 1 therefore possess distinctly different sound reflecting and absorbing properties than the rear-most acoustic shell 100*c* because the orientation of exposed sound sound reflecting panels 106*a* and exposed sound absorbing panels 106*b* is different. Moreover, the angular orientation of the sound absorbing panels 106*b* and the magnitude of the internal volumes defined by the clusters 107 impact the way that sound is reflected and absorbed by each of the shells 100*a*, 100*b*, 100*c*.

As mentioned, each shell 100 is capable of localized surficial deformation such that in FIG. 1, for example, any of the shells 100*a*, 100*b*, 100*c* can be expanded to occupy the opened configuration such that is by the rear-most shell 100*c*, or can be contracted to occupy a closed configuration, whereby the sound absorbing panels 106*b* are collapsed upon each other in a manner that the only exposed surfaces of the shell 100 include those of the sound reflecting panels 100*a*. In such a configuration, the clusters 107 of sound absorbing panels 106*b* are essentially closed upon themselves such that the previously existent recesses are of zero volume. To achieve this local deformation, the shells 100 are equipped with a plurality of mechanical actuators (not seen in FIG. 1).

Figure 2:
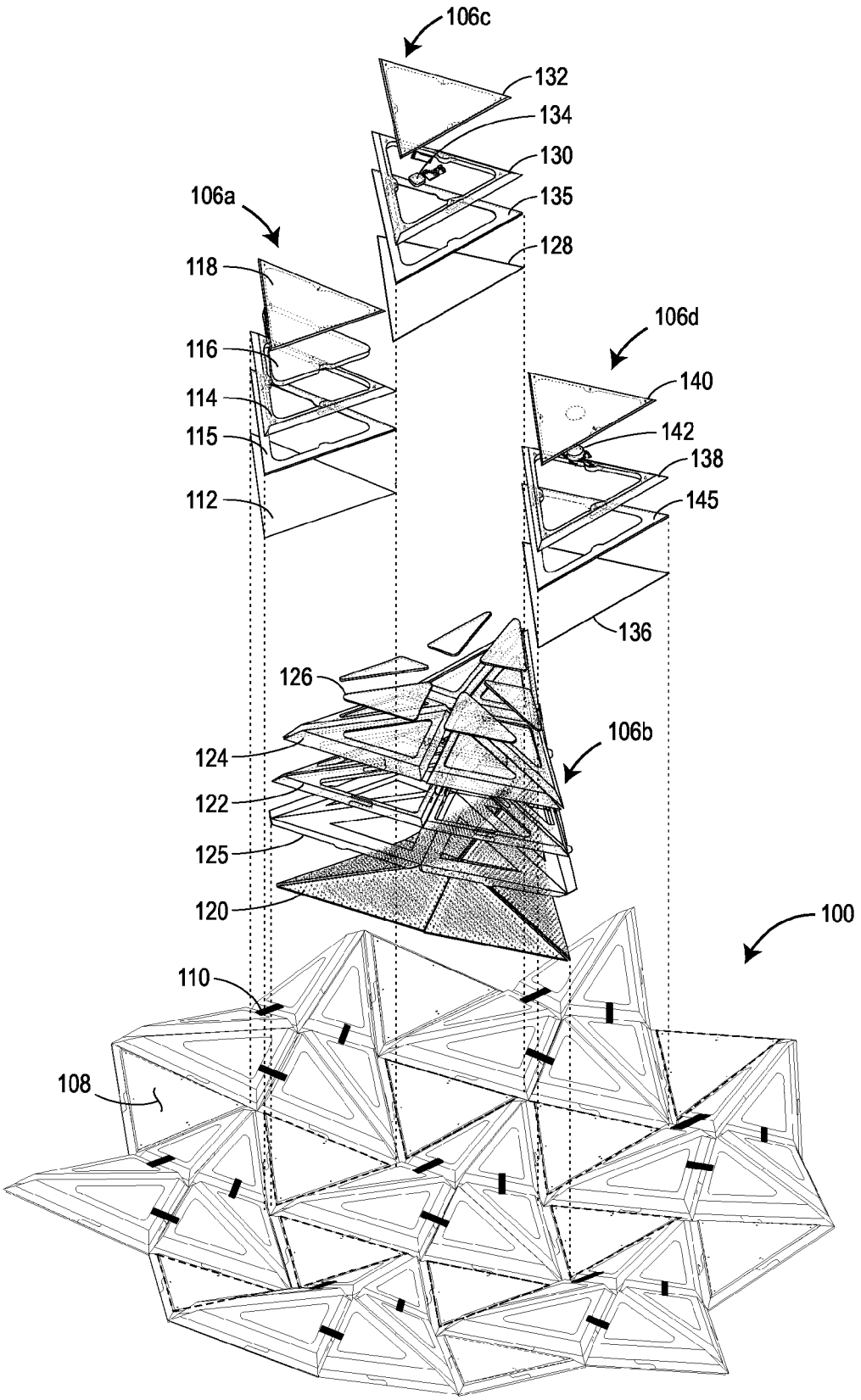
FIG. 2 is a perspective view and partial exploded perspective view of an acoustic shell of the system of FIG. 1.

FIG. 2 depicts one of the shells 100 of FIG. 1 from a top side 108 (i.e., the side facing the ceiling 102 in FIG. 1). FIG. 2 additionally includes an exploded perspective view of each of the various panels 106 of the shell 100.

As mentioned above, the individual panels 106 of the shell 100 are pivotally connected to each other such as to allow for localized surficial deformation. In one example, the panels 106 have chamfered side edges to provide for the necessary free range of motion and are connected to each other by way of mechanical or chemical means of mating adjacent elements across the system so as to produce continuity of the membrane and flexural hinge system. In one example, the flexible membrane can include a rubber or other synthetic material adhered to a front side of supporting frames of the panels 106, as will be described, via an adhesive such as 3M™ VHB™ Tape or mechanical clamping detail mating face plate to frame element and integral membrane. So configured, the flexible membrane can serve as a flexural hinge between the panels 106. Preferably, the flexible membrane can be cut to include openings and appropriate geometries not to interfere with the acoustic properties of the panels 106 themselves. In other examples, the shell 100 does not use a flexible membrane for the hinge, but rather another type of hinge such as a barrel hinge or other mechanical coupler enabling the desired range of movement could be used. In yet another example, the hinge could be provided for by a piece or sheet of shape memory alloy, for example, creating a foldable joint between adjacent panels 106. The shape memory alloy may then be manipulated between an at least partially folded state and a flat state depending on the magnitude of an electric charge applied to the alloy to move (e.g., pivot) the panels 106 relative to each other.

As shown in FIG. 2, the top side 108 of each shell 100 includes a plurality of actuators 110 arranged for imparting localized surficial deformation of the shell 100. In the present example, each actuator 110 attaches between two adjacent sound absorbing panels 106*b* generally perpendicular to the joint between the panels 106*b*. This allows for the localized contraction and expansion of the sound absorbing panels 106*b*, the movement of which naturally results in movement of the sound reflecting panels 106*a* to accomplish the various configurations of the shell 100 as discussed above with reference to FIG. 1. In one example, the actuators 110 include linear actuators that are electrically driven, magnetically driven, or otherwise suitable for the intended purpose. Other types of actuators can also be used. While the actuators 110 are described in this example as being connected to the sound absorbing panels 106*b*, the other examples could alternatively or additionally include the actuators 110 connected to the sound reflecting panels 106*a* depending of the origami pattern utilized and the desired functional objectives.

Still referring to FIG. 2, the upper portion illustrates exploded views of the sound reflecting panels 106*a*, the sound absorbing panels 106*b*, and the electronics panel 106*c* of the shell 100. Additionally, as will be described below, FIG. 2 depicts an exploded view of an optional electro-acoustic panel 106*d*, one or more of which could be included in the shell 100. As can be seen, each of the panels 106 comprises a composite structure.

The sound reflecting panels 106*a* include an exposed surface layer 112, a backing frame 114, a solid infill panel 116, and a backing layer 118. In FIG. 2, the exploded view of the sound reflecting panel 106*a* is also depicted as including a portion 115 of the aforementioned flexible membrane disposed between the exposed surface layer 112 and the backing frame 114. Although the membrane 115 is illustrated as being cut to the size of the panel 106*a*, this is only for the sake of illustration to show the sandwiched positional relationship of the membrane relative to the other components of the panel 106*a*. In practice, the portion 115 constitutes a segment, which is aggregated with other similar portions through the incorporation of adhesive seams, for example, to form a continuous sheet of the flexible membrane, which also forms part of the composite structure of the other panels 106 of the shell 100, as will be described.

With continued reference to FIG. 2, the solid infill panel 116 is disposed within the backing frame 114 and may be in contact with or in close proximity to the exposed surface layer 112 across a majority of the area of the exposed surface layer 112. The backing layer 118 assists in holding the solid infill panel 116 in position. In one example, the exposed surface layer 112, backing frame 114, and backing layer 118 can be constructed of wood, bamboo, aluminum, plastic, or any other suitable material and can be secured together with any suitable fastener (e.g., a mechanical fastener, an adhesive fastener, or otherwise). The solid infill panel 116 can be constructed of any one of a variety of materials having a combination of material characteristics and dimensional thickness constituting an overall material density of 2.5 psf. In one example, the solid infill panel 116 can be a 1 and ¼" thick piece of bamboo plywood, but other materials having different thicknesses can be used to achieve the desired objective.

Figure 3:
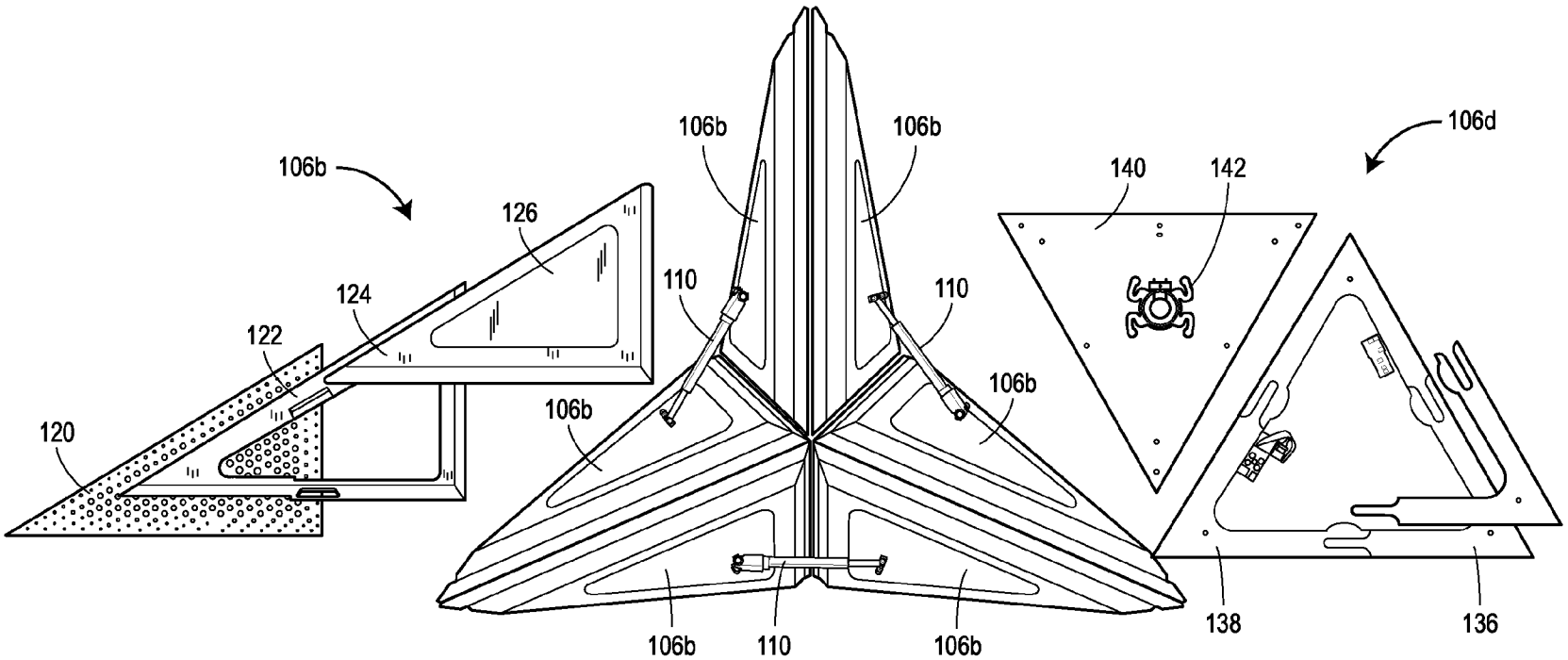
FIG. 3 is a partial perspective view an partial exploded view of the acoustic shell of FIGS. 1 and 2.

Still referring to FIG. 2 and in combination with FIG. 3, the sound absorbing panels 106*b* of the shell 100 include a perforated surface layer 120, a backing frame 122, a sound absorbing fill panel 124, and a backing layer 126. In FIG. 2, the exploded view of the sound absorbing panel 106*b* is also depicted as including a portion 125 of the aforementioned flexible membrane disposed between the perforated surface layer 120 and the backing frame 122. Similar to that described above with respect to the sound reflecting panels 106*a*, although the portion 125 of the membrane is illustrated as being cut to the size of the sound absorbing panel 106*b*, this is only for the sake of illustration to show the sandwiched positional relationship of the membrane relative to the other components. In practice, the portion 125 constitutes a segment, which is aggregated with other segments by way of adhesive seams, for example, to form a continuous sheet of the flexible membrane that also includes portion 115. As such, the membrane connects the sound reflecting and absorbing panels 106*a*, 106*b* together, as discussed above.

With continued reference to FIG. 2 and with reference to FIG. 3, the perforated surface layer 120 of the sound absorbing panel 106*b* is bonded to the backing frame 122 with the portion 125 of the flexible membrane (shown in FIG. 2)

sandwiched therebetween. The sound absorbing fill panel 124 is formed such as to fit within the backing frame 122 and have a surface that lies in contact with or in close proximity to the perforated surface layer 120. As shown in FIG. 2, the sound absorbing fill panel 124 also defines a recess 128, in which the backing layer 126 is received and affixed. The backing layer 126 provides a solid panel for securing to the actuators 110, as shown in FIG. 3, for example. In one example, the perforated surface layer 120, the backing frame 122, and backing layer 126 can be constructed of wood, bamboo, aluminum, plastic, or any other suitable material. The sound absorbing fill panel 124 can be constructed of a porous expanded polypropylene material or some other material having suitable acoustic absorption properties.

As mentioned, the sound reflecting and absorbing panels 106*a*, 106*b* of the present application include sound reflecting and absorbing characteristics. The sound reflecting and absorbing characteristics of the sound reflecting and absorbing panels 106*a*, 106*b*, respectively, can both be expressed in terms of sound absorption coefficients. Table 1, set forth immediately below, provides sound absorption coefficients across a range of frequencies for each of the panels 106*a*, 106*b* of one example of the system of the present disclosure.

TABLE 1

| | Frequency (Hz) | | | | | |
|---|---|---|---|---|---|---|
| | 125 | 250 | 500 | 1k | 2k | 4k |
| Sound Absorbing Material-Absorption Coefficients ($\times 10^{-2}$) | 5-10 | 15-25 | 75-85 | 80-90 | 85-95 | 80-90 |
| Sound Reflecting Panel-Absorption Coefficients ($\times 10^{-2}$) | 10 | 15 | 10 | 5 | 5 | 5 |

Referring back to FIG. 2, the electronics panel 106*c* for the shell 100 of the present example is similar to the sound reflecting panels 106*a* in that it includes an exposed surface layer 128, a backing frame 130, and a backing layer 132. Also, like the sound reflecting and absorbing panels 106*a*, 106*b* discussed above, the electronics panel 106*c* includes a portion 135 of the aforementioned flexible membrane disposed between the exposed surface layer 128 and the backing frame 130. Although the membrane 135 is illustrated as being cut to the size of the panel 106*c*, this is only for the sake of illustration to show the sandwiched positional relationship of the membrane relative to the other components of the panel 106*c*. In practice, the portion 135 constitutes a segment, which is aggregated with other segments by way of adhesive seams, for example, to form a continuous sheet of the flexible membrane, which also includes the portions 115, 125 of the sound reflecting and absorbing panels 106*a*, 106*b*. Finally, as shown, the electronics panel 106*c* includes an electronics set 134 that constitutes a portion of the control system for controlling the localized surficial deformation of the shell 100 including controlling the actuation of the actuators 110. The individual components of the electronics set 134 will be described more fully below, and the exposed surface layer 128, backing frame 130, and backing layer 132 essentially serve to accommodate the storage of the electronics set 134. That is, the backing frame 130 is bonded to and sandwiched between the exposed surface later 128 and backing layer 132 such that a cavity is formed for containing the electronics set 134.

Finally, as mentioned, the shell 100 of the present example may optionally include one or more electro-acoustic panels 106*d*. The electro-acoustic panel 106*d* is constructed generally identical to the electronics panel 106*c*, in that it includes an exposed surface layer 136, a backing frame 138, a backing layer 140, and a portion 145 of the flexible membrane. However, instead of including the electronics set 134, the electro-acoustic panel 106*d* includes an acoustic transducer 142 (also depicted in FIG. 3) that turns the electro-acoustic panel into a Distributed Mode Loudspeaker (DML). The acoustic transducer 142 is mounted to the backing layer 140 (as shown in FIG. 3) of the electro-acoustic panel 106*d* to produce the desired functionality.

As discussed above, the sound absorbing panels 106*b* of the present example are movable (e.g., pivotable) relative to one another and relative to the sound reflecting panels 106*a* by way of the actuators 110 to change, alter, and adjust the acoustic properties of the shell 100. Moreover, in examples that include one or more electro-acoustic panels 106*d*, those panels 106*d* become acoustic generators that can further influence acoustic properties of the shell 100 and any space in which the shell 100 is suspended.

Figure 4:
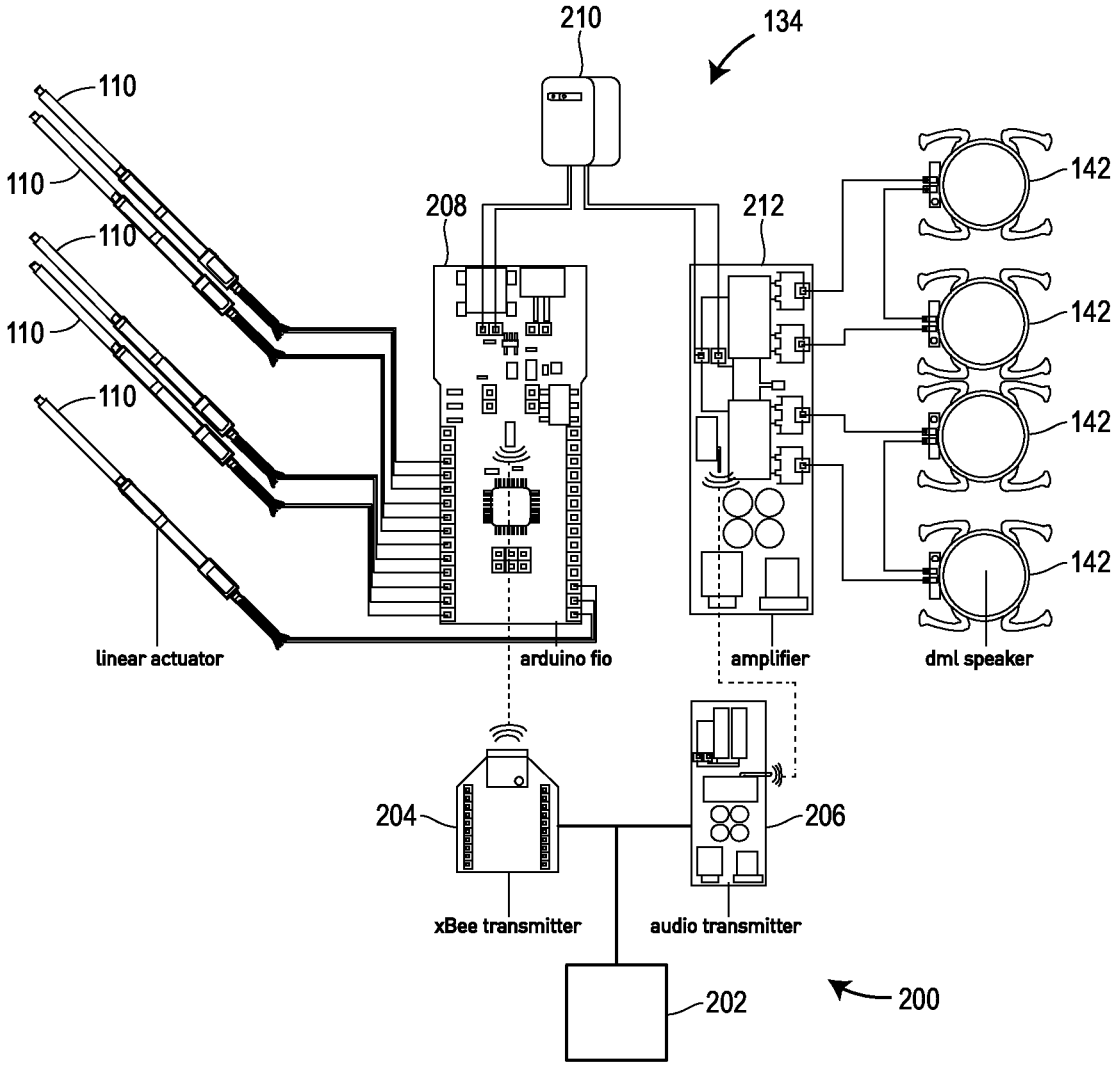
FIG. 4 is a schematic diagram of one example of a control system for an acoustic system constructed in accordance with the principles of the present disclosure.

To achieve the desired controls, any system 10 of the present application can be equipped with a control system 200 such as that depicted in FIG. 4. The control system 200 includes a programmed logic controller (PLC) 202, a logic transmitter 204, an optional audio transmitter 206 (for shells 100 that include electro-acoustic panels 106*d*), the electronics set 134 carried by the electronics panel 106*c* described above, the actuators 110, and one or more optional acoustic transducer 142 (for shells 100 that include electro-acoustic panels 106*d*), each carried by one or more optional electro-acoustic panels 106*d*. The electronics set 134 carried by the electronics panel 106*c* includes a controller 208, a power supply 210, and an optional amplifier 212 (for shells 100 that include electro-acoustic panels 106*d*). The PLC 202 can be a personal computer for example. The logic transmitter 204 can be a wireless transmitter in data communication with the controller 208, which in turn, is in data communication with the actuators 110 either via wires or wirelessly. In one example, the logic transmitter can include an XBee wireless transmitter and the controller 208 can include an Arduino FIO controller. In examples that include electro-acoustic panels 106*d*, the audio transmitter 206 communicates wirelessly with the amplifier 212, which in turn, communicates either via wires or wirelessly with the DMLs. The power supply 210 on the electro-acoustic panel 106*d* provides power to the electronics set 134 and to the actuators 110 and acoustic transducers 142, if necessary.

So configured, in order to adjust the configuration of the panels 106 of the shell 100, the PLC 202 sends instructions to the on-board controller 208 via the logic transmitter 204, for actuating any one or more of the actuators 110 to arrive at the desired configuration of the shell 100. Additionally, in examples that include the electro-acoustic panels 106*d*, the PLC 202 sends audio signals to the on-board amplifier 212 via the audio transmitter 206. The on-board amplifier 212 then amplifies the audio signal and supplies it to the desired acoustic transducers 142, which then function to resonate their respective panels and create the desired audio output. The aforementioned logic for controlling the actuators 110 may be logic that is pre-programmed in the PLC 202 to achieve a desired acoustical result based on some pre-determined parameters. For example, if the shell 100 is included within a concert hall that is hosting a rock concert, the PLC 202 might be manually instructed (e.g., by a sound engineer) to apply a first set of logic to actuate the actuators 110 and configure the shell 100 in a first configuration. However, if subsequently, the same concert hall was hosting the concert of a classical pianist, the PLC 202 might be manually instructed (e.g., by a sound engineer) to apply a second set of logic to actuate the actuators 110 and configure the shell 100 in a second configuration that is distinct from the first.

Figure 5:
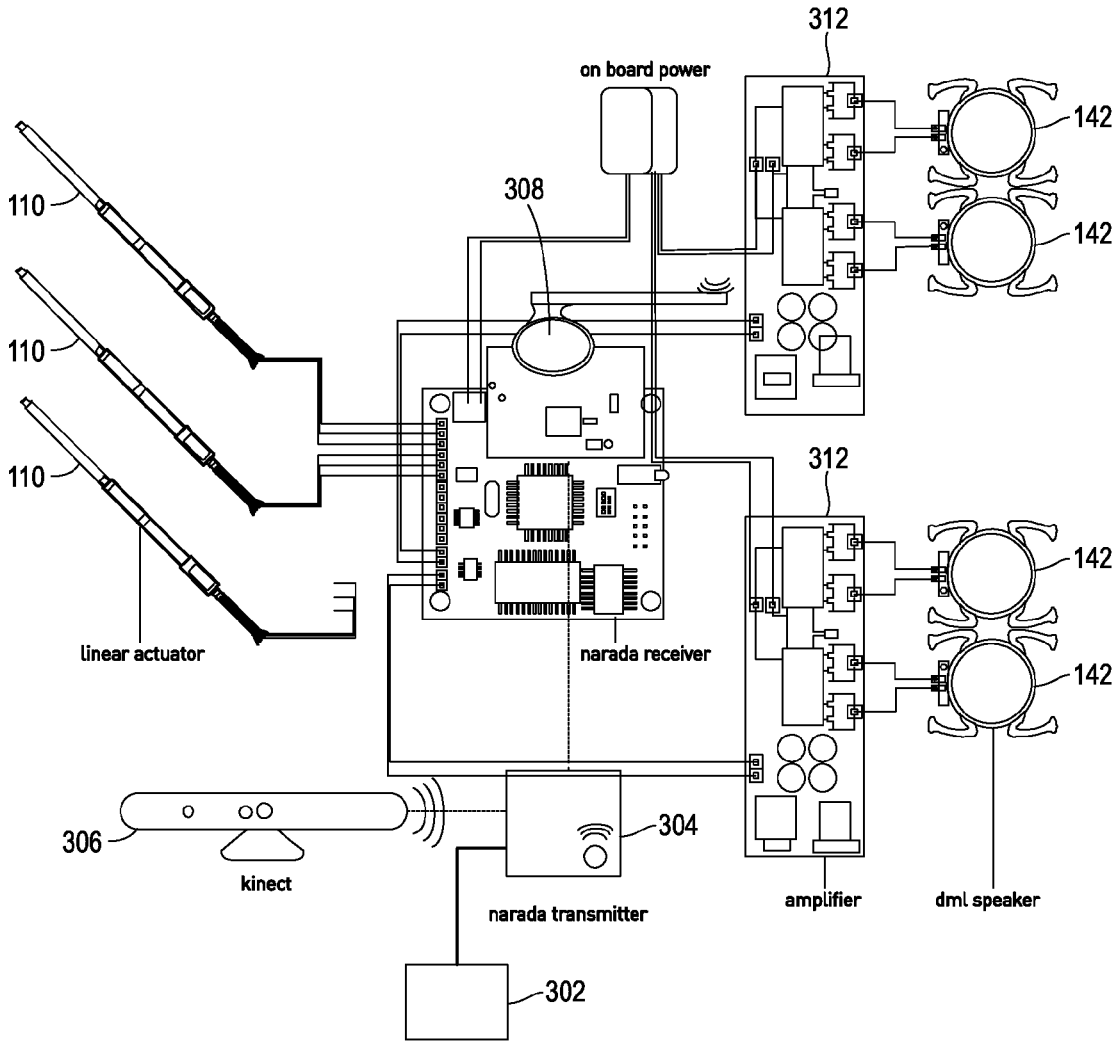
FIG. 5 is a schematic diagram of another example of a control system for an acoustic system constructed in accordance with the principles of the present disclosure.

Alternatively, the shell 100 could be equipped with a more sophisticated control system 300 (e.g., shown in FIG. 5) for controlling the configuration of the shell 100 based on real-time changes in the acoustical environment in which the shell 100 resides. More specifically, the shell 100 could include a control system 300 that is capable of changing the configuration of the shell 100 based on one or more determinations made as a function of the ambient properties of the environment. For example, as depicted in FIG. 5, such a control system 300 could include a programmed logic controller (PLC) 302, a logic transmitter 304, the electronics set 134 carried by the electronics panel 106*c* described above, the actuators 110, and one or more optional acoustic transducers 142 (for shells 100 that include electro-acoustic panels 106*d*), each carried by one or more optional electro-acoustic panels 106*d*, and any one or more of a plurality of sensors 306. The electronics set 134 carried by the electronics panel 106*c* includes a controller 308, a power supply 310, and one or more optional amplifiers 312 (for shells 100 that include electro-acoustic panels 106*d*).

The PLC 302 can be a personal computer, for example. The logic transmitter 304 can be a wireless transmitter in communication with the personal computer and in data communication with the controller 308, which in turn, is in data communication with the actuators 110 either via wires or wirelessly. In one example, the logic transmitter 304 can include a wireless transmitter and the controller 308 can include a wireless receiver, each operating in accordance with the Narada multicast protocol. The one or more sensors 306 can include at least one of an acoustic pressure sensor for sensing sound in the space, an infrared projector for irradiating infrared light waves into the space, a digital camera for sensing profiles of reflective light in the space, a temperature sensor for detecting temperatures or temperature profiles in the space, and/or any other suitable type of sensor capable of obtaining information suitable for the intended purpose. In one example, the one or more sensors 306 utilizes a combination of infrared and camera-based technologies such as that implemented in the Kinect™ technology to sense the occupancy and/or movement of individuals in the space around and/or below the shell 100. In examples that include electro-acoustic panels 106*d*, the logic transmitter 304 can also communicate wirelessly with the amplifiers 312, through the logic receiver 308. The amplifiers 312 thereby, in turn, communicate either via wires or wirelessly with the acoustic transducers 142. The power supply 310 on the electro-acoustic panel 106*d* provides power to the electronics set 134 and to the actuators 110 and acoustic transducers 142, if necessary.

With this alternative control system 300, the system 10 of the present disclosure can be capable of detecting in real-time the ambient properties of the space and adjusting the configuration of the one or more shells 100 to have a desired acoustic effect. For example, through the use of acoustic pressure sensors, the control system 300 can determine that a room has too much or too little reverberation and it can adjust the configuration of one or more shells 100 that are suspended in the space accordingly. Furthermore, through the use of Kinect™ technology, the control system 300 can determine where in a room a crowd of people may or may not be gathered, and thereby the system 300 can adjust the configuration of one or more shells 100 that are suspended in the space to achieve a desired acoustic effect.

As illustrated in FIGS. 1 and 2, each shell 100 of the system 10 thus far described has a finite number of panels 106. For example, in FIG. 2, the shell 100 includes fifty-four (54) total panels including 42 sound absorbing panels 106*b*, one (1) electronics panel 106*c*, and the remaining eleven (11) panels 106 can all be sound reflecting panels 106*a*, or one or more of them may optionally include electro-acoustic panels 106*d*. This shell 100, however, is merely one example of a system 10 constructed in accordance with the present disclosure. In fact, due to the repeatability of the rigid origami construct employed, the number of panels 106 in any given shell 100 can be limitless. This is exhibited by the schematic illustration depicted in FIG. 6, as well as FIGS. 7A, 7B, and 7C.

Figure 6:
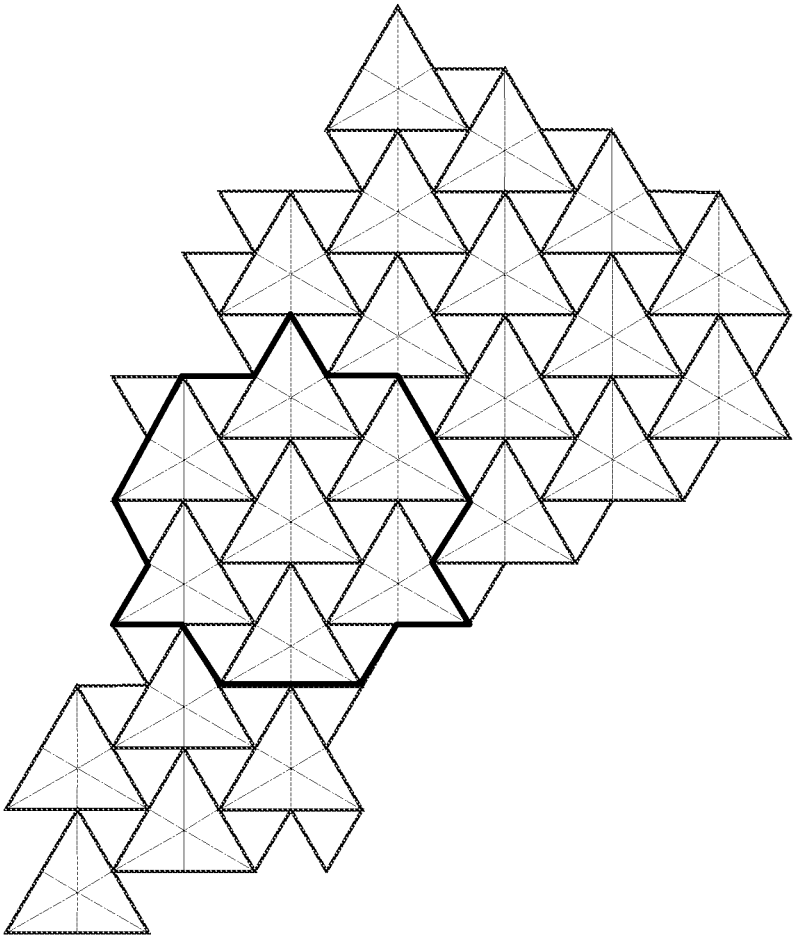
FIG. 6 is a schematic representation of an origami pattern utilized in the system of FIGS. 1 to 3.

The dark outlined central portion of the tessellated pattern shown in FIG. 6 constitutes an area equal to the number of panels of the shell 100 described above, but any shell 100 can be expanded to include any number of panels 106, as illustrated. Thus, the size and range of configurations of any shell 100 constructed in accordance with the present disclosure is limitless. Moreover, while in FIG. 1, each of the panels 106 are depicted as being easily distinguishable with the human eye, advances in micro-control technology could allow for the panels 106 to be reduced in size such that entirety of the shell 100 appears to be a single continuous fluid-like body with pivoting joints that could only be detected upon close inspection.

Figure 7A:
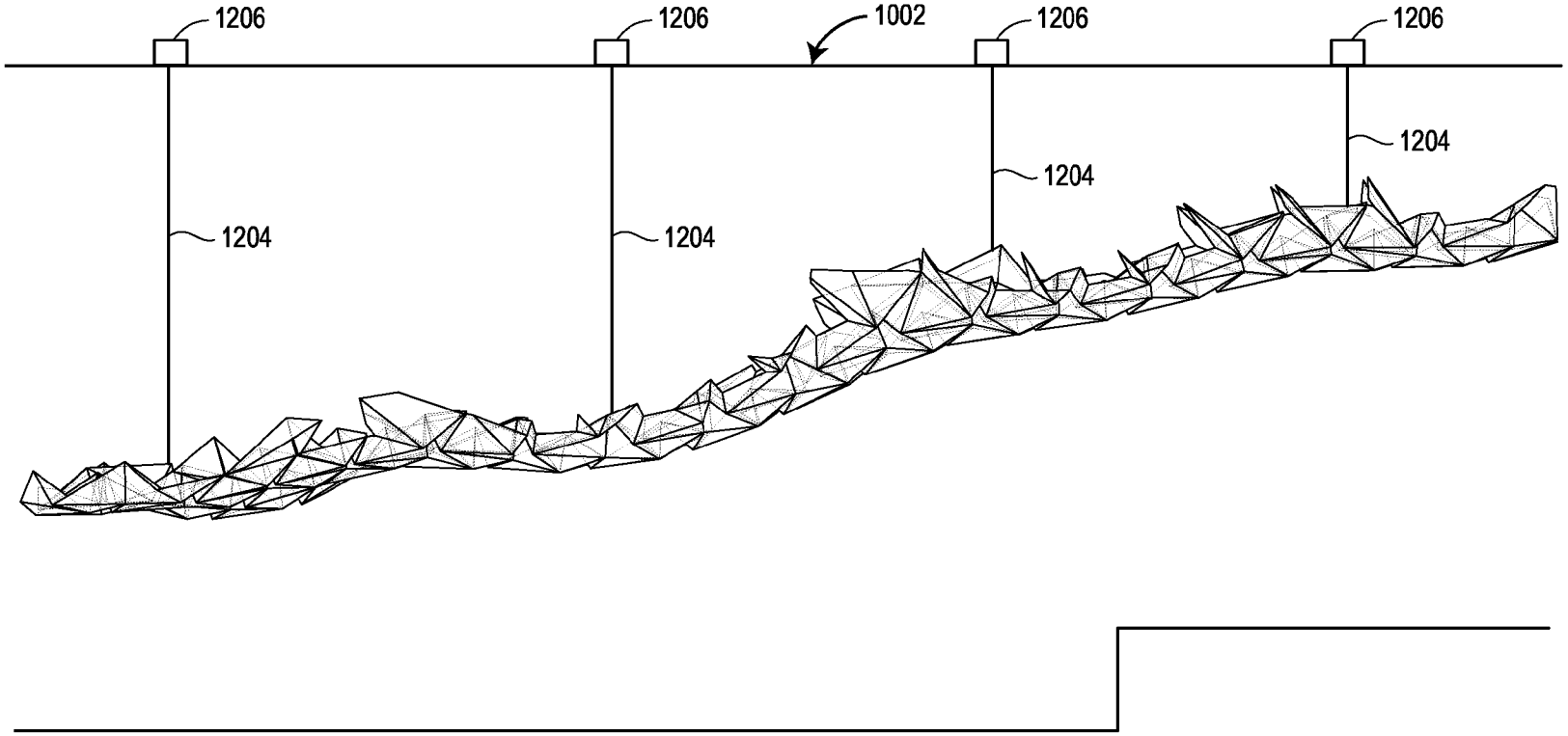
FIGS. 7A-7C are sectional perspective views of another example of a system constructed in accordance with the principles of the present disclosure.
Figure 7B:
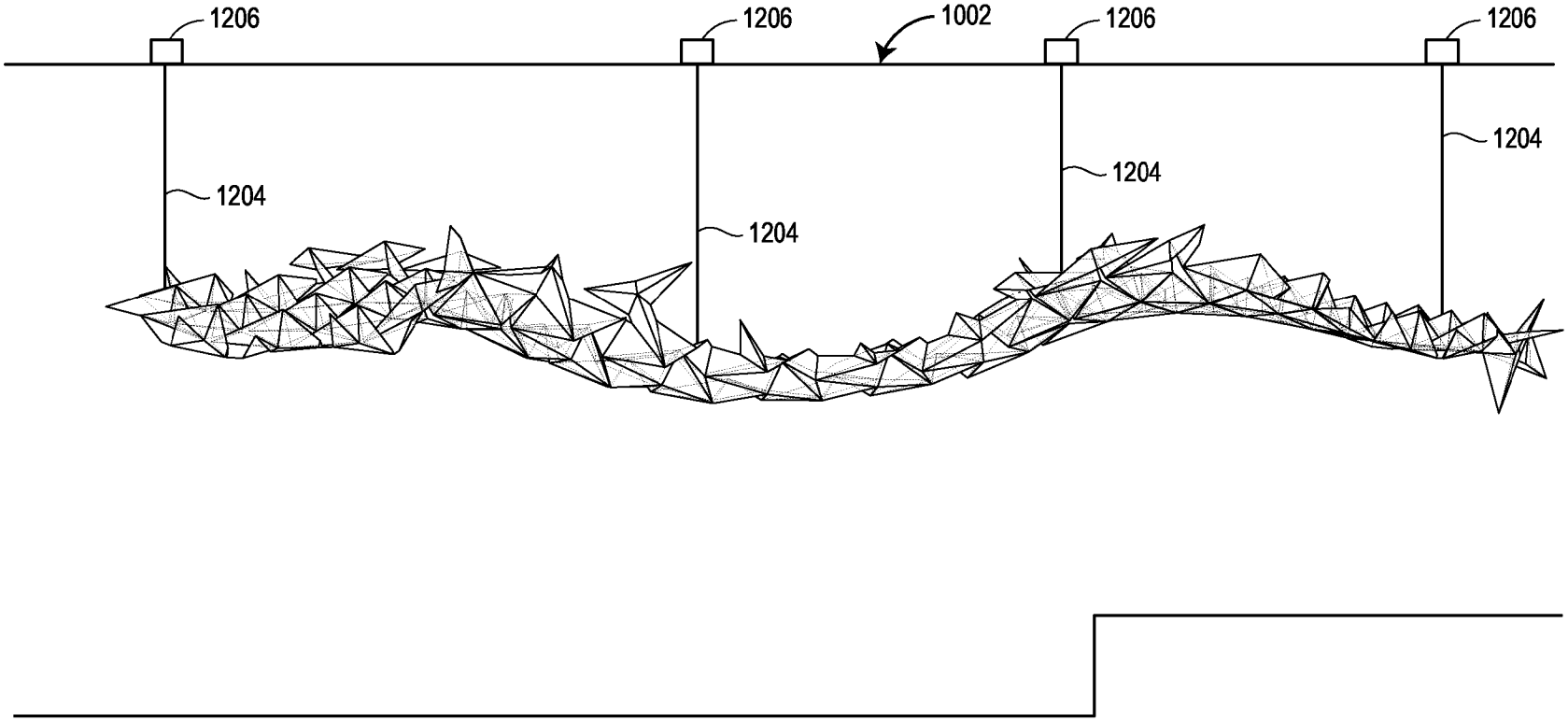
Figure 7C:
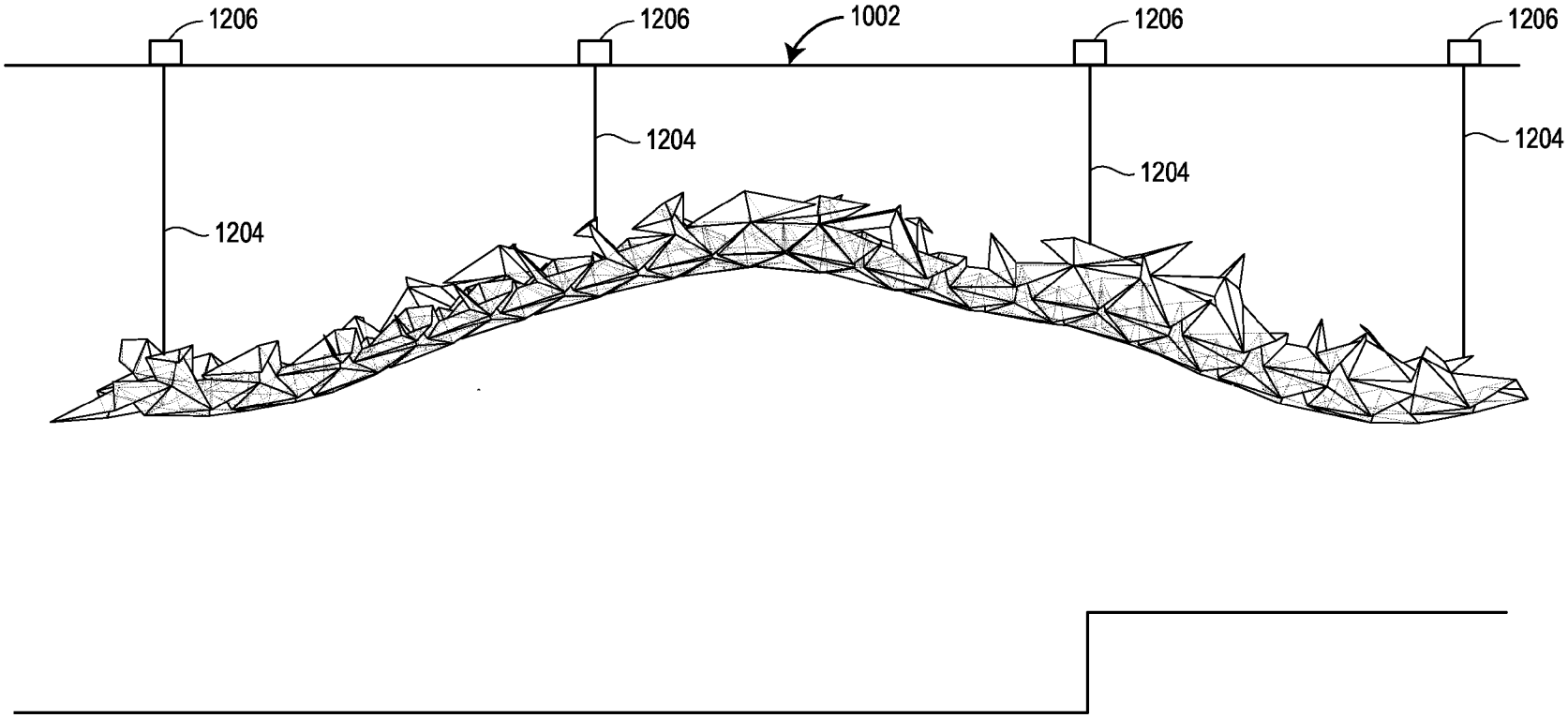

With this understanding, FIGS. 7A-7C depict another embodiment of a system 1000 including a shell 1100 suspended from a ceiling 1002 of a space (e.g., a concert hall) by way of a suspension system 1200. The shell 1100 can be constructed in accordance with the teachings for the shells 100 described above, with the only difference being the number of panels 106. However, instead of having multiple shells 100 occupying a common space, as depicted in FIG. 1, the system 1000 of FIGS. 7A-7C includes a single shell 1100 of much larger gross dimensions. As shown, the suspension system 1200 can include a series of vertical suspension members 1204 for hanging the shell 1100, as well as one or more gross displacement actuators 1206 for adjusting the position of different portions of the shell 1100 relative to the ceiling 1002. The suspension members 1204 might include cables, wires, rack and pinion structures, or any other suitable component. The gross displacement actuators 1206 might include motors, pulleys, etc. By comparing FIGS. 7A, 7B, and 7C, actuation of the various gross displacement actuators 1206 adjusts the position of various portions of the shell 1100 relative to the ceiling 1002, thereby adjusting the magnitude and shape of the volume of the space located beneath shell 1100, which in turn, directly impacts the acoustics. This gross motor deformation of the shell 1100, combined with the localized surficial deformation described above provides another layer to the adjustability and dynamically tunable environment that the present disclosure enables.

Figure 8:
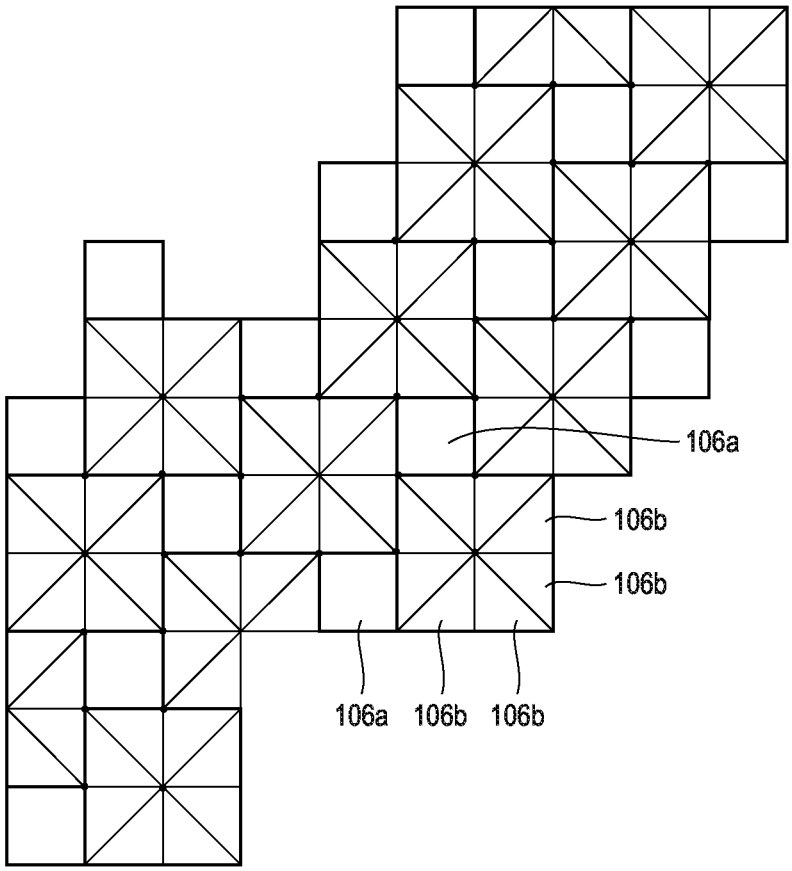
FIG. 8 is a schematic representation of an alternative origami pattern for use in accordance with the principles of the present disclosure.
Figure 9:
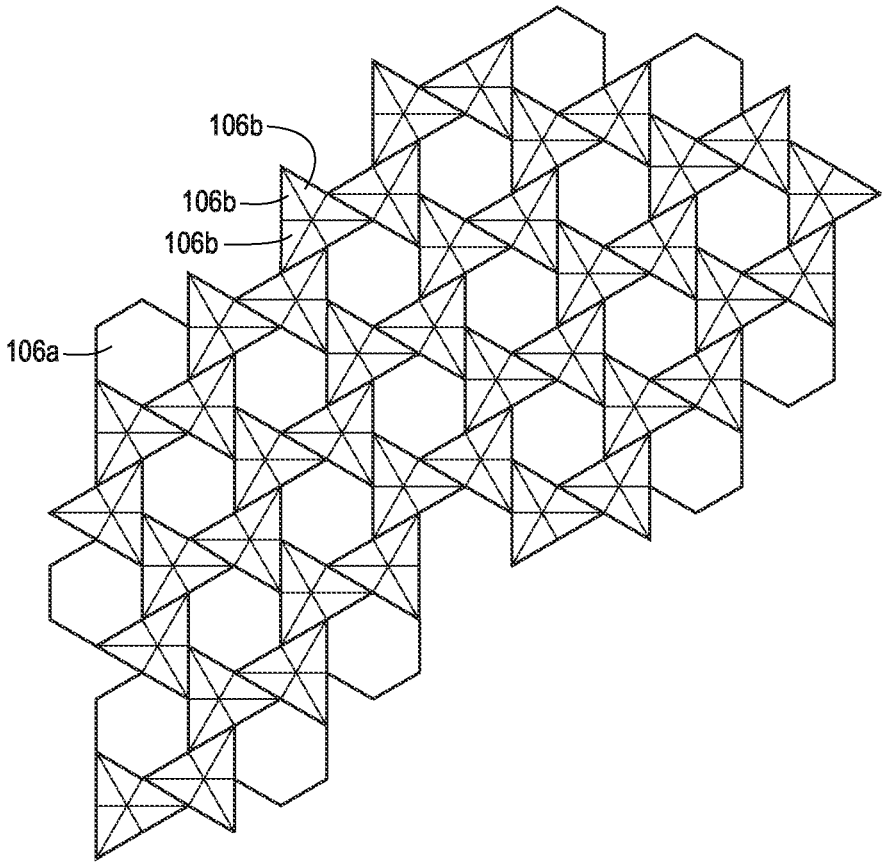
FIG. 9 is a schematic representation of another alternative origami pattern for use in accordance with the principles of the present disclosure.

While the shells 100 and 1100 thus far disclosed have been described as including panels 106 having two different size triangles in accordance with the rigid origami pattern depicted in FIGS. 1, 2, and 6, for example, this patter is only a single example and the disclosure is not limited thereto. For example, the shells 100, 1100 could include panels 106 comporting to any suitable contractable/expandable rigid origami patter such as those depicted in FIGS. 8 and 9. In FIG. 8, each of the sound absorbing panels 106*b* are equally sized triangles, while the sound reflecting panels 106*a* are square panels. In FIG. 9, the panels 106 include a combination of triangular panels 106*a* and hexagonal panels 106*b*. Any suitable configuration of panels is within the scope of the disclosure. Moreover, in any of the foregoing examples, the identification of which panels are sound reflecting and which are sound reflecting is only by way of example. In FIG. 1, for example, the shells 100 could be reconfigured such that the larger panels constituted the sound absorbing panels and the smaller panels constituted the sound refleting panels, or still further, some large and small panels could be sound absorbing and/or some large and small panels could be sound absorbing.

From the foregoing, the various systems and methods of the present disclosure offer advantages by packaging an acoustic solution into a lightweight system capable of aggregation, and can be customized within overarching geometries by substituting panel types into a range of existing spaces and configuration. The dual-actuation capacity (i.e., the surficial and gross volumetric deformations) allows for significant variation in spatial volume. Back-mounted operation via the actuators and suspension systems permit uncluttered exposed surface areas exposed to view and can be constructed to be aesthetically appealing and functional. The system design offers the control of both early acoustic energy (i.e., the sound reflections occurring shortly after the direct sound at both the listener and the performer locations) and late acoustic energy (i.e., diffusion and reverberation) through the sound absorbing and sound reflecting panels as well as dynamic electro-acoustic amplification simultaneously in a single system.

Finally, the present disclosure is not limited to the examples disclosed in the specification above, but rather, is defined by the spirit and scope of the pending claims and is intended to encompass all variations and substitutions that fall within the claims, as well as the disclosure including the drawings.

What is claimed is:

1. A system comprising:

an acoustic shell comprising a plurality of panels arranged in a tessellated pattern relative to one another, the plurality of panels including at least one sound reflecting panel and at least one sound absorbing panel, the at least one sound reflecting panel having an exposed surface a majority of which comprises a sound reflecting surface, the at least one sound absorbing panel having an exposed surface a majority of which comprises a sound absorbing surface;

a plurality of hinges connecting edges of at least three of the panels to edges of immediately adjacent panels such that each panel is movably connected to at least one other immediately adjacent panel;

a plurality of surficial actuators, each surficial actuator connected between at least two of the plurality of panels for moving the two panels relative to each other such that the plurality of surficial actuators can manipulate the plurality of panels to change the overall sound reflecting and sound absorbing properties of the acoustic shell; and a controller for at least controlling the surficial actuators.

2. The system of claim 1, wherein the plurality of panels includes at least one electro-acoustic panel.

3. The system of claim 2, wherein the at least one electro acoustical panel comprises an acoustic transducer.

4. The system of claim 1, wherein the plurality of panels are arranged in accordance with the geometric properties of rigid origami.

5. The system of claim 1, wherein each of the plurality of panels comprises a triangular panel of either a first size or a second size.

6. The system of claim 1, further comprising a flexible membrane fixed to and connecting the plurality of panels together, wherein each of the plurality of hinges comprises a portion of the flexible membrane connected between two adjacent panels.

7. The system of claim 1, further comprising at least one sensor in communication with the controller for transmitting ambient data to the controller, the at least one sensor to either capture the sound in the space, measure human occupancy and/or movement, project light, capture one or more images, capture moving images such as video or film, or any combination thereof.

8. The system of claim 1, wherein each of the plurality of surficial actuators comprises a linear actuator.

9. The system of claim 1, further comprising a suspension system connected to the acoustic shell and adapted to suspend the acoustic shell in a space below a ceiling, the suspension system including at least one gross displacement actuator for adjusting the distance of different portions of the acoustic shell from the ceiling.

10. The system of claim 1, wherein the sound reflecting surface has a sound absorption coefficient in a range from approximately $10\times10^{-2}$ to approximately $5\times10^{-2}$ within a range of frequencies from approximately 125 Hz to approximately 4 kHz, and the sound absorbing surface has a sound absorption coefficient in a range from approximately $5\times10^{-2}$ to approximately $90\times10^{-2}$ within a range of frequencies from approximately 125 Hz to approximately 4 kHz.

11. A venue comprising:

a housing defining a space having ambient properties;

an acoustic shell wholly suspended within the space of the housing, the acoustic shell comprising a plurality of panels arranged in a tessellated pattern relative to one another, the plurality of panels including at least one sound reflecting panel and at least one sound absorbing panel, the at least one sound reflecting panel having an exposed surface a majority of which comprises a sound reflecting surface, the at least one sound absorbing panel having an exposed surface a majority of which comprises a sound absorbing surface;

a plurality of hinges connecting edges of at least three of the panels to edges of immediately adjacent panels such that each panel is movably connected to at least one other immediately adjacent panel;

a plurality of surficial actuators, each surficial actuator connected between at least two of the plurality of panels for moving the two panels relative to each other such that the plurality of surficial actuators can manipulate the plurality of panels to change the overall sound reflecting and sound absorbing properties of the acoustic shell; and a controller for at least controlling the surficial actuators.

12. The venue of claim 11, wherein the plurality of panels includes at least one electro-acoustic panel.

13. The venue of claim 12, wherein the at least one electro acoustical panel comprises an acoustic transducer.

14. The venue of claim 11, wherein the plurality of panels are arranged in accordance with the geometric properties of rigid origami.

15. The venue of claim 11, wherein each of the plurality of panels comprises a triangular panel of either a first size or a second size.

16. The venue of claim 11, further comprising a flexible membrane fixed to and connecting the plurality of panels together, wherein each of the plurality of hinges comprises a portion of the flexible membrane connected between two adjacent panels.

17. The venue of claim 11, further comprising at least one sensor in communication with the controller for transmitting ambient data to the controller, the at least one sensor to either capture the sound in the space, measure human occupancy and/or movement, project light, capture one or more images, capture moving images such as video or film, or any combination thereof.

18. The venue of claim 11, wherein each of the plurality of surficial actuators comprises a linear actuator.

19. The venue of claim 11, wherein the housing includes a ceiling, and the venue further comprises a suspension system suspending the acoustic shell in the space from and below the ceiling, the suspension system including at least one gross displacement actuator for adjusting the distance of different portions of the acoustic shell from the ceiling.

20. The venue of claim 11, wherein sound reflecting surface has a sound absorption coefficient in a range from approximately $10\times10^{-2}$ to approximately $5\times10^{-2}$ within a range of frequencies from approximately 125 Hz to approximately 4 kHz, and the sound absorbing surface has a sound absorption coefficient in a range from approximately $5\times10^{-2}$ to approximately $90\times10^{-2}$ within a range of frequencies from approximately 125 Hz to approximately 4 kHz.

21. A method of controlling the acoustics of a space, the method comprising:

determining a set of desired acoustic characteristics for a space having a ceiling;

determining a desired sound absorbing property of a tessellated acoustic shell that is suspended within the space entirely below the ceiling, the tessellated acoustic shell comprising a plurality of panels, the plurality of panels including at least one sound reflecting panel and at least one sound absorbing panel, a plurality of hinges connecting edges of at least three of the panels to edges of immediately adjacent panels such that each panel is movably connected to at least one other immediately adjacent panel, the at least one sound reflecting panel having an exposed surface a majority of which comprises a sound reflecting surface, the at least one sound absorbing panel having an exposed surface a majority of which comprises a sound absorbing surface;

determining a desired sound reflecting property of the tessellated acoustic shell; and adjusting actual sound absorbing and sound reflecting properties of the tessellated acoustic shell toward the desired sound absorbing and reflecting properties by moving at least one of the plurality of panels of the tessellated acoustic shell relative to each other.

22. The method of claim 21, wherein adjusting actual sound absorbing and reflecting properties of the tessellated acoustic shell further comprises adjusting the distance of different portions of the acoustic shell from the ceiling within the space.

23. The method of claim 21, further comprising sensing at least on ambient property of the space, the at least one ambient property selected from a group consisting of acoustic pressure changes in the space, bodily movement in the space, temperature in the space, a temperature profile in the space, a profile of reflective light in the space.

24. The method of claim 21, wherein determining the set of desired acoustic characteristics for the space and determining the desired sound absorbing property of the tessellated acoustic shell are based at least partly on the at least one sensed ambient property of the space.

25. The method of claim 21, wherein adjusting the actual sound absorbing and reflecting properties of the tessellated acoustic shell toward the desired sound absorbing and reflecting properties comprises changing an orientation of the sound reflecting panels relative to the sound reflecting panels.

26. The method of claim 21, further comprising generating sound with at least one electro-acoustic panel of the tessellated acoustic shell.

* * * * *